US006063211A

United States Patent [19]

Soeda et al.

[11] Patent Number: 6,063,211

[45] Date of Patent: May 16, 2000

[54] HIGH STRENGTH, HIGH DUCTILITY TITANIUM-ALLOY AND PROCESS FOR PRODUCING THE SAME

[75] Inventors: Seiichi Soeda, Tokyo; Hideki Fujii, Futtsu; Hiroyuki Okano; Michio Hanaki, both of Chigasaki, all of Japan

[73] Assignees: Nippon Steel Corporation, Tokyo; Toho Titanium Co., Ltd., Kanagawa, both of Japan

[21] Appl. No.: 08/750,627

[22] PCT Filed: Apr. 19, 1996

[86] PCT No.: PCT/JP96/01078

§ 371 Date: Feb. 7, 1997

§ 102(e) Date: Feb. 7, 1997

[87] PCT Pub. No.: WO96/33292

PCT Pub. Date: Oct. 24, 1996

[30] Foreign Application Priority Data

Apr. 21, 1995 [JP] Japan ..... 7-097301
Apr. 21, 1995 [JP] Japan ..... 7-097302

[51] Int. Cl.[7] ..... C22C 14/00

[52] U.S. Cl. ..... 148/421; 148/669; 420/417; 420/421

[58] Field of Search ..... 148/669, 670, 148/671, 421; 420/417, 421

[56] References Cited

U.S. PATENT DOCUMENTS

| | | | |
|---|---|---|---|
| 2,640,773 | 6/1953 | Pitler | 75/177 |
| 4,886,559 | 12/1989 | Shindo et al. | 148/421 |
| 5,188,677 | 2/1993 | Fukai et al. | 148/501 |
| 5,342,458 | 8/1994 | Adams et al. | 148/670 |

FOREIGN PATENT DOCUMENTS

| | | |
|---|---|---|
| 0 322 087 A2 | 6/1989 | European Pat. Off. . |
| 30-5303 | 7/1955 | Japan . |
| 55-34856 | 9/1980 | Japan . |
| 4-272146 | 9/1992 | Japan . |
| 7-268516 | 10/1995 | Japan . |
| 1022806 | 3/1966 | United Kingdom . |

OTHER PUBLICATIONS

Liu et al, "Effects of Oxygen and Heat Treatment on the Mechanical Properties of Alpha and Beta Titanium Alloys", *Metallurgical Transactions A*, vol. 19A, Mar. 1988, 527–542, XP 002041099.

Donachi, "Titanium Groupings", *Titanium, Technical Guide*, 1988, 28, 14, 157–172, XP002041100.

*Primary Examiner*—John Sheehan
*Attorney, Agent, or Firm*—Pollock, Vande Sande & Amernick

[57] ABSTRACT

A high strength, high ductility titanium alloy comprising O, N and Fe as strengthening elements and the balance substantially Ti, the contents of the strengthening elements satisfying the following relationships (1) to (3):

(1) from 0.9 to 2.3% by weight of Fe, (2) up to 0.05% by weight of N, and (3) an oxygen equivalent value Q, which is defined by the formula mentioned below, of 0.34 to 1.00

$$Q=[O]+2.77[N]+0.1[Fe]$$

wherein [O] is an oxygen content (% by weight), [N] is a nitrogen content (% by weight) and [Fe] is an iron content (% by weight), the titanium alloy having a tensile strength of at least 700 MPa and an elongation of at least 15%. Part of Fe may be replaced with Cr and/or Ni. Fe, Cr and Ni may be introduced from a carbon steel or stainless steel, or they may be introduced from sponge titanium containing these elements.

12 Claims, 1 Drawing Sheet

HIGH STRENGTH, HIGH DUCTILITY TITANIUM-ALLOY AND PROCESS FOR PRODUCING THE SAME

TECHNICAL FIELD

The present invention relates to a high strength, high ductility titanium alloy and a process for producing the same. The present invention relates, in more detail, to a high strength, high ductility titanium alloy containing no alloying elements which increase the production cost, such as Al, V and Mo, and having a tensile strength as high as at least 700 MPa, preferably at least 850 MPa, particularly preferably at least 900 MPa and an elongation as high as at least 15%, preferably at least 20%, and a process for producing the same.

BACKGROUND ART ($\alpha+\beta$)-alloys and $\beta$-alloys containing Al, V, Zr, Sn, Cr, Mo, and the like have heretofore been known as high strength titanium alloys. In general, these conventional alloys have a tensile strength of at least 900 MPa, and there are few titanium alloys having a strength level between that of pure titanium and that of the conventional alloys, namely from about 700 to 900 MPa.

For example, Ti—6Al—4V alloy is a typical alloy of the ($\alpha+\beta$)-alloys, and has a tensile strength of 850 to 1,000 MPa and an elongation of 10 to 15% in an annealed state. There is Ti—3Al—2.5V alloy which has a strength level lower than the alloy mentioned above, and which has a tensile strength of 700 to 800 MPa and is excellent in ductility.

However, since these alloys contain V which is a high cost alloying element, they have the disadvantage that their cost is high.

Accordingly, the alloys mentioned below have been proposed in which V, a high cost alloying element, is replaced with Fe, a low cost element: Ti—5Al—2.5Fe alloy ("Titanium Science and Technology," Deutche Gesellshaft fur Metallkunde E.V. p1335 (1984)), and Ti—6Al—1.7Fe—0.1Si alloy and Ti—6.5Al—1.3Fe alloy (Advanced Material & Processes, p43 (1993)).

However, the above alloys which have been proposed contain a large amount of Al, and have high strength and low ductility at high temperature. The alloys have, therefore, poor hot workability compared with pure Ti. These alloys have the problem that the hot working cost is still high though the raw material cost is lowered by replacing V with Fe.

Accordingly, an alloy has been proposed which contains neither Al nor V and which utilizes O (oxygen) and N (nitrogen) as interstitial strengthening elements. For example, Japanese Patent Kokai Publication No. 61-159563 discloses a process for producing a pure Ti forged material having a tensile strength at the level of 80 kgf/mm$^2$ class and an elongation of at least 20% which process comprises rough forging at high temperature including upsetting forging, finish forging, and heat treating at temperature of 500 to 700° C. for up to 60 minutes. The process, however, requires complicated forging such as upsetting forging and heavy deformation, and it cannot be adopted in general.

Japanese Patent Kokai Publication No. 1-252747 discloses a high strength titanium alloy excellent in ductility which requires no specific forming, and which can be formed into products having various shapes such as sheets and rods by conventional rolling. The titanium alloy disclosed herein contains O, N and Fe as strengthening elements. The contents of these strengthening elements are defined as follows: the Fe content is from 0.1 to 0.8% by weight, and the oxygen equivalent value Q, which is defined to be equal to [O]+2.77[N]+0.1[Fe], is from 0.35 to 1.0. The N content is defined to be practically at least 0.05% by weight as disclosed in examples, and the titanium alloy is made to have fine microstructure in the ($\alpha+\beta$) dual and equiaxed phase or lamellar layers. As a result, the titanium alloy has a tensile strength of at least 65 kgf/mm$^2$.

The disclosed titanium alloy attains a tensile strength of at least 65 kgf/mm$^2$ and an elongation of at least 20% by solid solution strengthening with O and N, and by microstructural grain refining effects obtained by utilizing an Fe content higher than that of pure titanium, and it attains a tensile strength of at least 85 kgf/mm$^2$ particularly when $Q \geqq 0.6$.

However, as shown in FIGS. 1 and 2 in the patent publication, the titanium alloy has a tensile strength of up to 95 kgf/mm$^2$ when $Q \leqq 0.8$, though it has an elongation of at least 15%. Moreover, though the titanium alloy has a tensile strength as high as from 95 to 115 kgf/mm$^2$ when Q=0.8 to 1.0, it has an elongation as low as up to 15%.

As described above, the titanium alloy does not always have both a high strength and a high ductility at the same time. Accordingly, a further development of a titanium alloy having both a high strength and a high ductility is desired.

Furthermore, although the alloy requires a N content as high as at least 0.05% by weight, the addition of such a large amount of N is extremely difficult in the production of the alloy by melting. Control of the addition amount is also difficult.

That is, since melting titanium is conducted in vacuum or in an inert gas atmosphere at low pressure, introducing nitrogen using a nitrogen gas is almost impossible during melting. Nitrogen, therefore, must be introduced in the form of a nitrogen-containing solid. To avoid a contamination with impurities which exert adverse effects on the properties of titanium, the addition of nitrogen-containing titanium is preferred. To obtain such a high nitrogen content as mentioned above, a technique such as addition of titanium containing a large amount of nitrogen becomes necessary. As a result, a compound such as TiN having a very high melting point of 3,290° C., and likely to form an undissolved portion, may form. Such undissolved TiN, etc. may remain as nitrogen-rich inclusions in the titanium alloy, and it may form a fatal defect such as the starting point of a fatigue failure. Moreover, since nitrogen is a gas component, the introduced nitrogen tends to evaporate even when the nitrogen is introduced in the form of a nitrogen-containing solid, and control of the nitrogen content is difficult.

DISCLOSURE OF THE INVENTION

An object of the present invention is to provide a titanium alloy having a still higher strength and a still higher ductility compared with the conventional alloys mentioned above while the content of nitrogen which is difficult to add is decreased.

According to a first aspect of the present invention, the object is achieved by a high strength, high ductility titanium alloy comprising O, N and Fe as strengthening elements and the balance substantially Ti, the contents of the strengthening elements satisfying the following relationships (1) to (3):

(1) from 0.9 to 2.3% by weight of Fe, (2) up to 0.05% by weight of N, and (3) an oxygen equivalent value Q, which is defined by the formula mentioned below, of 0.34 to 1.00

$$Q=[O]+2.77[N]+0.1[Fe]$$

wherein [O] is an oxygen content (% by weight), [N] is a nitrogen content (% by weight) and [Fe] is an iron content (% by weight), the titanium alloy having a tensile strength of at least 700 MPa and an elongation of at least 15%.

According to a second aspect of the present invention, the object is also achieved by a high strength, high ductility titanium alloy comprising O, N, Fe and at least one element selected from Cr and Ni as strengthening elements and the balance consisting substantially of Ti, the contents of the strengthening elements satisfying the following relationships (1) to (6):

(1) from 0.9 to 2.3% by weight of the total amount of Fe, Cr and Ni, (2) at least 0.4% by weight of Fe, (3) up to 0.25% by weight of Cr, (4) up to 0.25% by weight of Ni, (5) up to 0.05% by weight of N, and (6) an oxygen equivalent value Q, which is defined by the formula mentioned below, of 0.34 to 1.00

$$Q=[O]+2.77[N]+0.1\{[Fe]+[Cr]+[Ni]\}$$

wherein [O] is an oxygen content (% by weight), [N] is a nitrogen content (% by weight), [Fe] is an iron content (% by weight), [Cr] is a Cr content (% by weight) and [Ni] is a Ni content (% by weight), the titanium alloy having a tensile strength of at least 700 MPa and an elongation of at least 15%.

According to a first viewpoint of the first or second aspect of the present invention, a high strength, high ductility titanium alloy which has the oxygen equivalent value Q of 0.34 to 0.68, a tensile strength of 700 to 900 MPa and an elongation of at least 20% is provided.

According to a second viewpoint of the first or second aspect of the present invention, a high strength, high ductility titanium alloy which has the oxygen equivalent value Q of 0.50 to 1.00, a tensile strength of at least 850 MPa and an elongation of at least 15% is provided.

According to a preferred mode based on the second viewpoint of the first or second aspect of the present invention, a high strength, high ductility titanium alloy which has the oxygen equivalent value Q of greater than 0.68 to 1.00 and a tensile strength exceeding 900 MPa is provided.

Furthermore, a third aspect of the present invention is a process for producing a high strength, high ductility titanium alloy according to the first or second aspect of the present invention which process comprises charging and melting at least one steel selected from carbon steels and stainless steels during the production of the titanium alloy by melting, so that Fe, or at least part of Fe, Cr and Ni as the strengthening elements is introduced from the steel.

A fourth aspect of the present invention is a process for producing the high strength, high ductility titanium alloy according to the first or second aspect of the present invention which process comprises producing sponge titanium by the use of a vessel containing Fe, or at least one element selected from Fe, Cr and Ni in the step for producing sponge titanium, so that the sponge titanium contains Fe or the at least one element selected from Fe, Cr and Ni which has been transferred therefrom and has invaded, and supplying the sponge titanium as at least part of the supply raw materials for Fe, or for the at least one element selected from Fe, Cr and Ni, as the strengthening element during the production of the titanium alloy by melting.

Although nitrogen which is an interstitial solid-solution element dissolved in the α-phase to solid-solution strengthen the alloy, control of the amount thereof necessary for strengthening during melting by VAR (vacuum arc melting) or the like is difficult. Moreover, when the content is excessive, the ductility is unpreferably lowered. In the present invention, therefore, the addition and the content control of nitrogen are made easy by decreasing the N content. Since nitrogen may be added in a decreased amount, N-rich inclusions in the raw materials for melting are decreased to such an extent that they can be made to disappear by VAR.

However, when the addition amount of N is decreased, the degree of strengthening the titanium alloy with N is also decreased. To ensure the strength, it is satisfactory to supplement a decrease in the amount of N with O or Fe which is a strengthening element. However, an increase in the amount of O lowers ductility. An increase in the amount of Fe similarly lowers the ductility. The latter instance is disclosed, for example, in test Nos. 9 and 10 of Table 3 in Japanese Patent Kokai Publication No. 1-252747.

As a result of conducting various experiments for the purpose of improving the strength as well as the ductility, the present inventors have discovered that an increase in the amount of Fe lowers the ductility when the N content is at least 0.055% by weight, and that an increase in Fe, therefore, does not lower the ductility but improves the strength when the N content is made less than 0.055% by weight, particularly when it is made less than 0.050% by weight. That is, the strength and the ductility are simultaneously improved by adjusting the N content to up to 0.05% by weight and the Fe content to at least 0.9% by weight.

The reasons for the effect described above are described below.

Since Fe is a β-phase-stabilizing element, an increase in the amount of Fe increases the amount of the β-phase, and as a result the amount of the α-phase decreases. Consequently, N which is an α-phase-stabilizing element is enriched in the α-phase which has decreased in amount. When the N content exceeds 0.05% by weight, a $Ti_2N$ superlattice phase tends to precipitate in the α-phase due to the enrichment, and the precipitates lower the ductility. The restriction of the N content to 0.05% by weight makes such a precipitation phase difficult to form, and an increase in the amount of Fe improves the strength.

When O exists in an excessively large amount, the superlattice phases of $Ti_3O$ and $Ti_2O$ are formed. However, the amount of O necessary for forming these superlattice phases is particularly large compared with that of N, and does not matter at all in the scope of the present invention.

According to the present invention, a titanium alloy attains a tensile strength of at least 700 MPa and an elongation of at least 15%. When a titanium alloy is solid-solution strengthened by simply increasing the amounts of O and N, the ductility is lowered, though the strength is increased. In the present invention, the N content is decreased to up to 0.05% by weight and then the amount of Fe is increased to at least 0.9% by weight, whereby the amount of the β-phase having good ductility is increased and good ductility of the alloy is ensured. At the same time, the contents of O, N and Fe which are strengthening elements are adjusted so that the oxygen equivalent value Q satisfies the relationship Q=0.34 to 1.00. As a result, the titanium alloy attains a tensile strength of at least 700 MPa and an elongation of at least 15%. The oxygen equivalent value Q herein is defined by the following formula:

$$Q=[O]+2.77[N]+0.1[Fe]$$

wherein [O] is an oxygen content (% by weight), [N] is a nitrogen content (% by weight) and [Fe] is an iron content (% by weight).

Especially according to the first viewpoint of the present invention, when the Q value is made to fall in a range of 0.34 to 0.68, a high strength titanium alloy particularly excellent in ductility is obtained which has a tensile strength of 700 to 900 MPa and an elongation of at least 20%. To ensure a tensile strength of at least 700 MPa, the Q value is required to be at least 0.34. To ensure an elongation of at least 20%, the Q value is required to be up to 0.68.

Furthermore, according to the second viewpoint of the present invention, when the Q value is made to fall in a range of at least 0.50 to 1.00, a titanium alloy is obtained which has a tensile strength of at least 850 MPa and an elongation of at least 15%, that is, which is ensured to have a still higher strength and a good ductility. To ensure a tensile strength of at least 850 MPa, the Q value is required to be at least 0.50. To ensure an elongation of at least 15%, the Q value is required to be up to 1.00.

According to a preferred mode based on the second viewpoint of the present invention, when the Q value is made to fall in a range of greater than 0.68 to 1.00, a titanium alloy is obtained which has a tensile strength exceeding 900 MPa and an elongation of at least 15%, that is, which is ensured to have the highest strength and a good ductility. To ensure a tensile strength exceeding 900 MPa, the Q value is required to be at least 0.68. To ensure an elongation of at least 15%, the Q value is required to be up to 1.00.

O, N and Fe are essential components as strengthening elements in the present invention, and exist without fail, in the alloy of the present invention, in content ranges satisfying the relationship with regard to the Q value. For the reasons mentioned above, the N content is required to be up to 0.05% by weight, and the Fe content in accordance therewith is required to be at least 0.9% by weight. However, when the Fe content becomes excessive, solidification segregation becomes significant, and the properties are deteriorated. Accordingly, the Fe content is defined to be up to 2.3% by weight.

In the present invention, part of Fe can be replaced with at least one element selected from Cr and Ni. Cr and Ni, as well as Fe, are β-phase-stabilizing elements. These elements make grains fine, and contribute to highly strengthening the titanium alloy. In this case, Q is defined by the following formula obtained by replacing the term [Fe] in the above-mentioned formula of Q with [Fe]+[Cr]+[Ni]:

$$Q=[O]+2.77[N]+0.1\{[Fe]+[Cr]+[Ni]\}$$

wherein [O] is an oxygen content (% by weight), [N] is a nitrogen content (% by weight), [Fe] is an iron content.(% by weight), [Cr] is a chromium content (% by weight), and [Ni] is a nickel content (% by weight).

In this case also, the range of Q according to the present invention is from 0.9 to 2.3. To increase the strength and the ductility simultaneously, the Q value is required to be at least 0.9. When the Q value exceeds 2.3, solidification segregation becomes significant and the properties are deteriorated as in case where Fe alone is added without adding Cr and Ni.

However, when at least one element selected from Cr and Ni is added, addition of Cr or Ni in a large amount results in the formation of $TiCr_2$ or $Ti_2Ni$ which are brittle compounds, and consequently the ductility is lowered. To prevent the phenomenon, it is necessary that the contents of Cr and Ni should be defined to be each up to 0.25% by weight, and that the content of Fe should be defined to be at least 0.4% by weight, preferably at least 0.5% by weight.

The titanium alloy of the present invention usually contains C, H, Mo, Mn, Si, S, etc. as impurities as in the case of conventional pure titanium or a conventional titanium alloy. The contents are, however, each less than 0.05% by weight.

The titanium alloy of the present invention is usually prepared as described below. Titanium is placed in a melting furnace, and arc melted in vacuum or in an Ar atmosphere (VAR melting). In the present invention, a carbon steel and/or a stainless steel may be supplied during melting, whereby Fe and at least one element selected from Cr and Ni can be added to Ti. Fe, Cr and Ni may be added in the total amount of 0.9 to 2.3% by weight by the procedure mentioned above. Alternatively, these elements may be added by the above procedure in combination with another addition procedure so that the addition amount falls in the range as mentioned above. Preferably, low cost scrap may also be used as a raw material.

Although there is no specific limitation on the addition raw materials, examples of the carbon steel and the stainless steel to be used are JIS-SS400, JIS-SUS430 (Fe—17Cr), JIS-SUS304 (Fe—18Cr—8Ni), JIS-SUS316 (Fe—18Cr—8Ni), JIS-SUS316 (Fe—18Cr—8Ni—2Mo), and the like. Although C, Mo, etc. are contained in these raw materials, the amounts of these elements are trace compared with the contents of Fe, Cr and Ni. These elements belong to impurities the contents of which are each less than 0.05% by weight.

In the present invention, Fe, Cr and Ni may also be added by other means as described below.

That is, in refining titanium and producing sponge titanium by reduction with Mg, i.e., by the Kroll process, a vessel made of a carbon steel or stainless steel is used. At least one element among Fe, Cr and Ni invade the sponge titanium from the vessel, and sponge titanium containing these elements is formed near the wall and the bottom of the vessel. Conventionally, the sponge titanium thus formed is separately collected and used for other applications. In the present invention, however, it is used as part of or the whole of raw materials for the Fe, Cr and Ni addition. As a result, it becomes possible to produce the titanium alloy at low cost.

As described above, the present invention is capable of not only providing a high strength, high ductility titanium alloy by adding O, N, Fe (and Cr and Ni) in defined amounts but also producing the titanium alloy at low cost by the use of the low cost raw materials. Accordingly, the present invention is industrially extremely advantageous.

Furthermore, since the titanium alloy of the invention does not contain Al as an alloying element, its hot workability is not lowered in contrast with conventional titanium alloys containing Al, and, therefore, its production is advantageous.

BEST MODE FOR CARRYING OUT THE INVENTION

Figure 1:
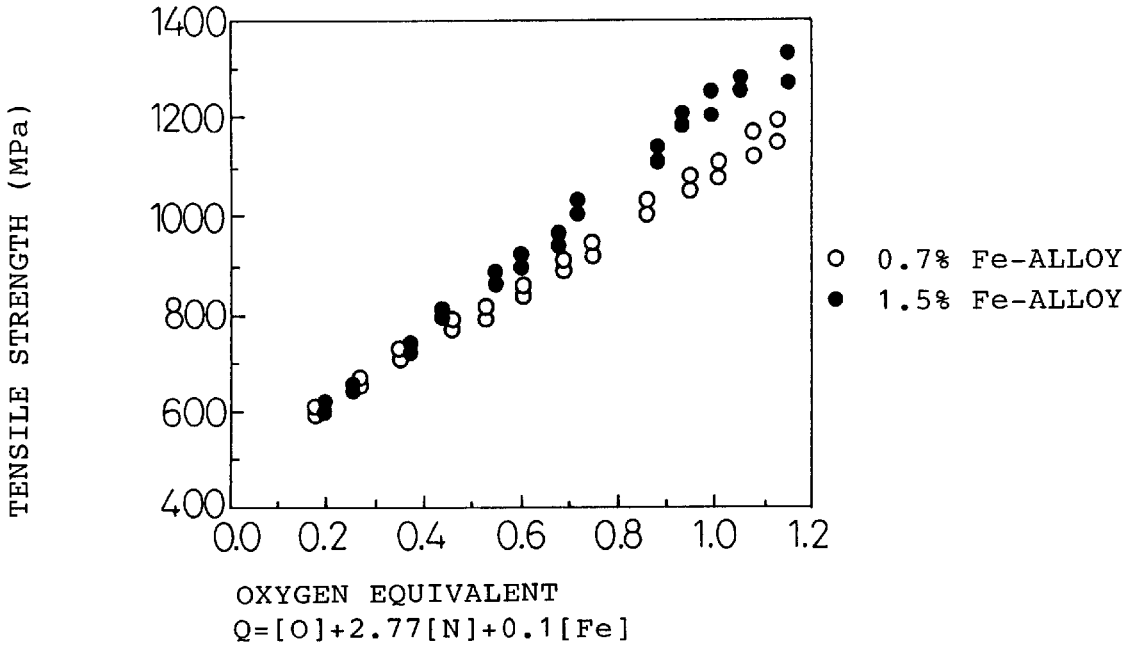
FIG. 1 is a graph showing the relationship between a Q value and a tensile strength.

The present invention will be illustrated in more detail by making reference to examples.

EXAMPLE 1

A high strength, high ductility titanium alloy having a tensile strength of 700 to 900 MPa and an elongation of at least 20% was produced on the basis of the first viewpoint of the present invention. In addition, in the present example, "comparative example" signifies that it is outside the scope of the first viewpoint, and does not necessarily signify that it is outside the scope of the second viewpoint.

(1) Cylindrical ingots having a diameter of 430 mm were prepared by VAR. The ingots were heated to 1,000° C., and forged to billets having a diameter of 100 mm. The billets were then heated to 850° C., and rolled to bars having a diameter of 12 mm. Moreover, the bars were annealed at 700° C. for 1 hour. The production instance was designated "bar".

(2) Cylindrical ingots having a diameter of 430 mm were prepared by VAR. The ingots were heated to 1,000° C., and forged to slabs having a thickness of 150 mm. The slabs were then heated to 850° C., and hot rolled to plates having a thickness of 4 mm. Moreover, the plates were annealed at 700° C. for 1 hour. The production instance was designated "hot rolled plate".

(3) The hot rolled plates were descaled, and cold rolled to sheets having a thickness of 1.5 mm. The production instance was designated "cold rolled sheet".

The bars, the hot rolled plates and the cold rolled sheets produced by the above procedures were subjected to tensile test (the following test pieces being adopted: bars: a test piece having a diameter of 12.5 mm and a gauge length of 50 mm; hot rolled plates and cold rolled sheets: a flat test piece having a width of 12.5 mm and a gauge length of 50 mm). Some of the test pieces were subjected to rotate-bending fatigue test (the non-failure strength at $10^7$ cycles being defined as fatigue strength). The results are shown in Table 1 to Table 3.

Samples shown in Table 1 are those which contained chemical components related to the first viewpoint of the first aspect in the present invention. The addition of Fe was carried out with a pure metal, FeTi or $Fe_2O_3$ (iron oxide).

Samples shown in Table 2 are those which contained chemical components related to the first viewpoint of the second aspect in the present invention. The addition of Fe, Ni and Cr was conducted with pure metals, FeCr, FeNi, FeTi or $Fe_2O_3$.

Table 3 shows examples of bars and hot rolled plates related to the production process of the present invention.

TABLE 1

| Test | Chemical component (wt. %) | | | | Tensile strength | Elong-ation | Fatigue strength | |
|---|---|---|---|---|---|---|---|---|
| No. | O | N | Q* | Fe | MPa | % | MPa | Remarks |
| 1 | 0.34 | 0.02 | 0.50 | 1.0 | 800 | 23.2 | 430 | Bar, Ex., (typical, Fe being near lower limit) |
| 2 | 0.29 | 0.02 | 0.50 | 1.5 | 790 | 23.8 | 440 | Bar, Ex, (typical) |
| 3 | 0.24 | 0.02 | 0.50 | 2.0 | 810 | 20.5 | 450 | Bar, Ex., (typical, Fe being near lower limit) |
| 4 | 0.28 | 0.045 | 0.50 | 1.0 | 780 | 20.7 | 420 | Bar, Ex., (N being near upper limit) |
| 5 | 0.28 | 0.05 | 0.52 | 1.0 | 810 | 20.5 | 400 | Bar, Ex., (N being upper limit) |

TABLE 1-continued

| Test | Chemical component (wt. %) | | | | Tensile strength | Elong-ation | Fatigue strength | |
|---|---|---|---|---|---|---|---|---|
| No. | O | N | Q* | Fe | MPa | % | MPa | Remarks |
| 6 | 0.23 | 0.06 | 0.50 | 1.0 | 820 | 16.6 | 310 | Bar, Comp. Ex., (N exceeding upper limit - elongation, fatigue x) |
| 7 | 0.22 | 0.01 | 0.34 | 0.9 | 720 | 25.0 | — | Bar, Ex., (Q being near lower limit) |
| 8 | 0.20 | 0.01 | 0.32 | 0.9 | 680 | 25.5 | — | Bar, Comp. Ex., (Q being low - strength being low x) |
| 9 | 0.39 | 0.02 | 0.60 | 1.5 | 880 | 20.7 | — | Bar, Ex. (Q being near upper limit) |
| 10 | 0.39 | 0.02 | 0.68 | 2.3 | 890 | 20.1 | — | Bar, Ex., (Q and Fe being upper limit) |
| 11 | 0.42 | 0.03 | 0.70 | 2.0 | 950 | 16.3 | — | Bar, Comp. Ex., Q (being high ductility being low x) |
| 12 | 0.27 | 0.01 | 0.38 | 0.8 | 680 | 26.0 | — | Bar, Comp. Ex., Fe (being low - strength being low x) |
| 13 | 0.37 | 0.01 | 0.65 | 2.5 | 910 | 15.0 | — | Bar, Comp. Ex., Fe (being high - strength being low x) |
| 14 | 0.33 | 0.02 | 0.52 | 1.2 | 820 | 23.0 | — | Hot rolled sheet, Ex. |
| 15 | 0.37 | 0.01 | 0.52 | 1.2 | 830 | 21.4 | — | Hot rolled sheet, Ex. |
| 16 | 0.27 | 0.01 | 0.40 | 1.0 | 700 | 27.0 | — | Cold rolled sheet, Ex. |
| 17 | 0.32 | 0.03 | 0.60 | 2.0 | 890 | 21.0 | — | Cold rolled sheet, Ex. |

Note:
*Q = an oxygen equivalent value = [O] + 2.77[N] + 0.1[Fe]
Ex. = Example = an example based on the first viewpoint of the first aspect in the present invention

TABLE 2

| Test | Chemical component (wt. %) | | | | | | | Tensile strength | Elong-ation | |
|---|---|---|---|---|---|---|---|---|---|---|
| No. | O | N | Q* | Fe | Ni | Cr | Fe + Ni + Cr | MPa | % | Remarks |
| 18 | 0.37 | 0.01 | 0.52 | 1.00 | 0.10 | 0.10 | 1.20 | 830 | 21.0 | Hot rolled plate, Ex. |
| 19 | 0.37 | 0.01 | 0.50 | 1.00 | 0.25 | 0.25 | 1.50 | 870 | 20.5 | Hot rolled plate, Ex., Ni and Cr being upper limit |
| 20 | 0.34 | 0.02 | 0.50 | 0.80 | 0.10 | 0.10 | 1.00 | 800 | 23.5 | Hot rolled plate, Ex., Fe + Cr + Ni being near lower limit |
| 21 | 0.34 | 0.02 | 0.49 | 0.70 | 0.10 | 0.10 | 0.90 | 790 | 22.6 | Hot rolled plate, Ex., Fe + Cr + Ni being lower limit |
| 22 | 0.27 | 0.01 | 0.39 | 0.55 | 0.15 | 0.15 | 0.85 | 680 | 27.0 | Hot rolled plate, Comp. Ex., Fe + Cr + Ni being up to lower limit, strength being low x |
| 23 | 0.32 | 0.03 | 0.60 | 1.70 | 0.15 | 0.15 | 2.00 | 880 | 22.3 | Hot rolled plate, Ex., Fe + Cr + Ni being near upper limit |
| 24 | 0.32 | 0.03 | 0.63 | 2.00 | 0.15 | 0.15 | 2.30 | 890 | 20.6 | Hot rolled plate, Ex., Fe + Cr + Ni being upper limit |
| 25 | 0.37 | 0.01 | 0.65 | 2.20 | 0.15 | 0.15 | 2.50 | 910 | 14.6 | Hot rolled plate, Comp. Ex., Fe + Cr + Ni exceeding upper limit, ductility being low |
| 26 | 0.29 | 0.02 | 0.49 | 1.00 | 0.30 | 0.05 | 1.35 | 770 | 18.2 | Hot rolled plate, Comp. Ex., Ni being excessive x |
| 27 | 0.29 | 0.02 | 0.44 | 0.45 | 0.30 | 0.15 | 0.90 | 730 | 16.3 | Hot rolled plate, Comp. Ex., Ni being excessive x, (Fe being relatively insufficient) |
| 28 | 0.29 | 0.02 | 0.49 | 1.0 | 0.10 | 0.30 | 1.40 | 760 | 17.5 | Hot rolled plate, Comp. Ex., Cr being excessive x |

Note:
*Q = an oxygen equivalent value = [O] + 2.77[N] + 0.1{[Fe] + [Cr] + [Ni]}
Ex. = Example = an example based on the first viewpoint of the second aspect in the present invention

TABLE 3

| Test | Chemical component (wt. %) | | | | | | | Tensile strength | Elong-ation | |
|---|---|---|---|---|---|---|---|---|---|---|
| No. | O | N | Q* | Fe | Ni | Cr | Fe + Ni + Cr | MPa | % | Remarks |
| 29 | 0.34 | 0.02 | 0.50 | 0.9 | 0 | 0.18 | 1.08 | 810 | 22.7 | Bar, Ex. Ni and Cr being added from scrap of SUS430, Fe being further added from FeTi |
| 30 | 0.37 | 0.01 | 0.52 | 1.0 | 0.07 | 0.15 | 1.22 | 820 | 22.1 | Hot rolled plate, Ex. Ni and Cr being added from scrap of SUS304, Fe being further added from FeTi |
| 31 | 0.37 | 0.01 | 0.52 | 1.0 | 0.08 | 0.16 | 1.24 | 840 | 21.5 | Hot rolled plate, Ex. Ni and Cr being added from scrap of SUS316, Fe being further added from FeTi (**) |
| 32 | 0.34 | 0.02 | 0.50 | 1.0 | 0 | 0 | 1.0 | 790 | 23.1 | Bar, Ex. entire Fe being added from SS400 (***) |
| 33 | 0.27 | 0.02 | 0.52 | 0.9 | 0.1 | 0.2 | 1.2 | 810 | 21.7 | Hot rolled plate, Ex. most of Fe, Ni and Cr being added from sponge titanium formed near vessel |

Note:
*Q = an oxygen equivalent value = [O] + 2.77[N] + 0.1{[Fe] + [Ni] + [Cr]}
** Mo in an amount of 2% in SUS316 becoming impurities in an amount of less than 0.02% in titanium alloy after melting.
*** C in an amount of 0.1% in SS400 becoming impurities in an amount of 0.01% in titanium alloy after melting In Table 1, Test Nos. 1 to 5, 7, 9 and 10 (bars), and Test Nos. 14 to 17 (hot rolled plates or cold rolled sheets) are examples based on the first viewpoint of the first aspect in the present invention. The features of each of the examples are described in the corresponding row in the remarks column. The designation "typical" signifies that the example is a typical one in the defined range.

Test No. 6 is a comparative example of a bar which had a low elongation and a low fatigue strength due to a high nitrogen content and which was not in the defined range. Test No. 8 is a comparative example of a bar which had a low Q value (oxygen equivalent value: [O]+2.77[N]+0.1[Fe]). It is evident from the comparison of Test No. 8 with Test No. 7 that since Q in Test No. 8 was slightly outside the lower limit of the defined range, the bar did not attain a tensile strength of 700 MPa. Test No. 11 is a comparative example of a bar which had a high Q value due to the high oxygen content. It is evident from the comparison of Test No. 11 with Test No. 10 that since Q in Test No. 11 was slightly outside the upper limit of the defined range, the bar had a high tensile strength and a low elongation. Test No. 12 is a comparative example of a bar which did not attain a tensile strength in the defined range due to a low Fe content. Moreover, Test No. 13 is a comparative example of a bar which had a solidification segregation, a high tensile strength and a considerably low elongation due to a high Fe content.

It can be seen from the above that a titanium alloy within the scope of the first viewpoint in the first aspect of the present invention has a tensile strength of 700 to 900 MPa and an elongation of at least 20%.

In Table 2, Test Nos. 18 to 21, 23 and 24 are examples related to hot rolled plates and cold rolled sheets based on the first viewpoint of the second aspect in the invention, and the features of each of the examples are described in the corresponding row in the remarks column.

Test No. 22 is a comparative example of a hot rolled plate which had a low content of Fe+Ni+Cr, and which had consequently a tensile strength not reaching the defined range. Test No. 25 is a comparative example of a cold rolled sheet which had a large content of Fe+Ni+Cr and a solidification segregation, and which had consequently a tensile strength exceeding the defined range and a considerably lowered elongation. Test No. 26 is a comparative example of a hot rolled plate which had an excessive content of Ni and an insufficient elongation. Test No. 27 is a comparative example of a hot rolled plate which had an insufficient content of Fe and an excessive content of Ni and a lowered elongation. Test No. 28 is a comparative example of a hot rolled plate which had an excessive content of Cr and a lowered elongation. It can be seen from the above that a titanium alloy in the range of the first viewpoint in the second aspect of the invention has a tensile strength of 700 to 900 MPa and an elongation of at least 20%.

In Table 3, Test No. 29 is an example of a bar which was prepared with scrap SUS430 as a Cr source and FeTi as an Fe source during VAR melting to have predetermined chemical components. Test No. 30 is an example of a hot rolled plate which was prepared with scrap SUS304 as an Ni and Cr source and FeTi as an Fe source to have predetermined chemical components. Test No. 31 is an example of a hot rolled plate which was prepared with scrap SUS316 as an Ni and Cr source and FeTi as an Fe source to have predetermined chemical components.

Test No. 32 is an example of a bar which was prepared with scrap of SS400 to have predetermined chemical components.

Furthermore, Test No. 33 is an example of a hot rolled plate which was prepared with cutout sponge titanium containing Fe, Ni and Cr which had invaded from a stainless steel vessel in the step of producing sponge titanium, to have predetermined chemical components.

The contents of the chemical components of the samples are as shown in Table 3. Moreover, each of the samples had a tensile strength of at least 700 MPa and an elongation of at least 20%, namely in the range of the first viewpoint in the first and the second aspect of the invention, and exhibited excellent properties.

EXAMPLE 2

A high strength, high ductility titanium alloy having a tensile strength of at least 850 MPa and an elongation of at least 15% was produced on the basis of the second viewpoint in the present invention. In addition, in the present example, "comparative example" signifies that it is outside the scope of the second viewpoint, and does not necessarily signify that it is outside the scope of the first viewpoint.

(1) Cylindrical ingots having a diameter of 430 mm were prepared by VAR. The ingots were heated to 1,000° C., and forged to billets having a diameter of 100 mm. The billets were then heated to 850° C., and rolled to bars having a diameter of 12 mm. Moreover, the bars were annealed at 700° C. for 1 hour. The production instance was designated "bar".

(2) Cylindrical ingots having a diameter of 430 mm were prepared by VAR. The ingots were heated to 1,000° C., and forged to slabs having a thickness of 150 mm. The slabs were then heated to 850° C., and hot rolled to plates having a thickness of 4 mm. Moreover, the plates were annealed at 700° C. for 1 hour. The production instance was designated "hot rolled plate".

(3) The hot rolled plates were descaled, and cold rolled to sheets having a thickness of 1.5 mm. The production instance was designated "cold rolled sheet".

The bars, the hot rolled plates and the cold rolled sheets produced by the above procedures were subjected to tensile test (the following test pieces being adopted: bars: a test piece having a diameter of 12.5 mm and a gauge length of 50 mm; hot rolled plates and cold rolled sheets: a flat test piece having a width of 12.5 mm and a gauge length of 50 mm). Part of them were subjected to rotate-bending fatigue test (the non-failure strength at $10^7$ cycles being defined as fatigue strength). The results are shown in Table 4 to Table 6.

Samples shown in Table 4 are those which contained chemical components related to the first aspect of the present invention. The addition of Fe was carried out with pure metal, FeTi or $Fe_2O_3$ (iron oxide)

Samples shown in Table 5 are those which contained chemical components related to the second aspect of the present invention. The addition of Fe, Ni and Cr was carried out with pure metals, FeCr, FeNi, FeTi or $Fe_2O_3$.

Table 6 shows examples of bars and hot rolled plates related to the production process of the present invention.

TABLE 4

| Test | Chemical component (wt. %) | | | | Tensile strength | Elong-ation | Rotate-bending fatigue strength | |
|---|---|---|---|---|---|---|---|---|
| No. | O | N | Fe | Q* | MPa | % | MPa | Remarks |
| 1 | 0.37 | 0.02 | 1.20 | 0.55 | 860 | 23.0 | — | Hot rolled plate, Ex. |
| 2 | 0.57 | 0.02 | 1.20 | 0.75 | 990 | 20.5 | — | Hot rolled plate, Ex. |
| 3 | 0.77 | 0.04 | 0.70 | 0.95 | 1100 | 14.0 | — | Hot rolled plate, Conventional Ex. |
| 4 | 0.75 | 0.04 | 0.90 | 0.95 | 1130 | 15.8 | — | Hot rolled plate, Ex., Fe being lower limit |
| 5 | 0.72 | 0.04 | 1.20 | 0.95 | 1150 | 16.5 | — | Hot rolled plate, Ex. |
| 6 | 0.27 | 0.02 | 1.20 | 0.45 | 820 | 23.5 | — | Hot rolled plate, Comp. Ex., Q being overly low - strength being low |
| 7 | 0.82 | 0.04 | 1.20 | 1.05 | 1190 | 9.5 | — | Hot rolled plate, Comp. Ex., Q being excessive - ductility being low |
| 8 | 0.53 | 0.045 | 1.00 | 0.75 | 1010 | 19.2 | 540 | Bar, Ex., N being near upper limit |
| 9 | 0.53 | 0.05 | 1.00 | 0.77 | 1040 | 18.5 | 550 | Bar, Ex., N being upper limit |
| 10 | 0.50 | 0.055 | 1.00 | 0.75 | 1020 | 11.0 | 360 | Bar, Comp. Ex., N being excessive - ductility and fatigue strength being low |
| 11 | 0.55 | 0.045 | 0.75 | 0.75 | 1010 | 12.5 | 390 | Bar, Comp. Ex., Fe being overly low - ductility and fatigue strength being low |
| 12 | 0.49 | 0.02 | 2.00 | 0.75 | 970 | 20.1 | 520 | Bar, Ex., Fe being near upper limit |
| 13 | 0.49 | 0.02 | 2.3 | 0.78 | 990 | 19.5 | 510 | Bar, Ex., Fe being upper limit |
| 14 | 0.44 | 0.02 | 2.50 | 0.75 | 980 | 11.5 | 360 | Bar, Comp. Ex., Fe being excessive - ductility and fatigue strength being low |
| 15 | 0.40 | 0.01 | 1.20 | 0.55 | 870 | 22.5 | — | Cold rolled sheet, Ex. |
| 16 | 0.50 | 0.01 | 1.20 | 0.65 | 910 | 21.7 | — | Cold rolled sheet, Ex. |

Note:
*Q = [O] + 2.77[N] + 0.1[Fe]

TABLE 5

| Test | Chemical component (wt. %) | | | | | | | Tensile strength | Elong-ation | |
|---|---|---|---|---|---|---|---|---|---|---|
| No. | O | N | Fe | Ni | Cr | Fe + Ni + Cr | Q* | MPa | % | Remarks |
| 17 | 0.57 | 0.02 | 1.0 | 0.1 | 0.1 | 1.2 | 0.75 | 980 | 20.7 | Hot rolled plate, Ex. |
| 18 | 0.60 | 0.02 | 0.6 | 0.15 | 0.1 | 0.9 | 0.75 | 980 | 19.8 | Hot rolled plate, Ex. Fe + Ni + Cr being lower limit |
| 19 | 0.60 | 0.02 | 0.6 | 0.25 | 0.25 | 1.1 | 0.77 | 990 | 18.8 | Hot rolled plate, Ex. Ni and Cr being upper limit |
| 20 | 0.61 | 0.02 | 0.65 | 0.10 | 0.05 | 0.80 | 0.75 | 930 | 12.5 | Hot rolled plate, Comp. Ex., Fe + Ni + Cr being insufficient, strength and ductility being low |
| 21 | 0.48 | 0.02 | 1.8 | 0.15 | 0.15 | 2.1 | 0.75 | 970 | 20.5 | Hot rolled plate, Ex. Fe + Ni + Cr being near upper limit |
| 22 | 0.48 | 0.02 | 2.0 | 0.15 | 0.15 | 2.3 | 0.77 | 980 | 20.2 | Hot rolled plate, Ex. Fe + Ni + Cr being upper limit |
| 23 | 0.43 | 0.02 | 2.15 | 0.17 | 0.18 | 2.5 | 0.75 | 960 | 11.5 | Hot rolled plate, Comp. Ex., Fe + Ni + Cr being excessive - ductility being low |
| 24 | 0.42 | 0.01 | 0.80 | 0.10 | 0.10 | 1.0 | 0.55 | 870 | 21.5 | Cold rolled sheet, Ex. |
| 25 | 0.42 | 0.01 | 0.65 | 0.30 | 0.05 | 1.0 | 0.55 | 860 | 11.5 | Cold rolled sheet, Comp. Ex., Ni being excessive - ductility being low |
| 26 | 0.42 | 0.01 | 0.65 | 0.05 | 0.30 | 1.0 | 0.55 | 870 | 12.5 | Cold rolled plate, Comp. Ex., Cr being excessive - ductility being low |

Note:
*Q = [O] + 2.77[N] + 0.1{[Fe] + [Ni] + [Cr]}

TABLE 6

| Test | Chemical component (wt. %) | | | | | | | Tensile strength | Elong-ation | |
|---|---|---|---|---|---|---|---|---|---|---|
| No. | O | N | Fe | Ni | Cr | Fe + Ni + Cr | Q* | MPa | % | Remarks |
| 27 | 0.56 | 0.03 | 0.9 | 0 | 0.18 | 1.08 | 0.75 | 970 | 21.0 | Hot rolled plate, Ex. Ni and Cr being added from scrap of SUS430, Fe being further added from FeTi |
| 28 | 0.54 | 0.03 | 1.0 | 0.07 | 0.22 | 1.29 | 0.75 | 990 | 20.8 | Hot rolled plate, Ex. Ni and Cr being added from scrap of SUS304, Fe being further added from FeTi |
| 29 | 0.53 | 0.03 | 1.0 | 0.08 | 0.24 | 1.32 | 0.75 | 990 | 21.1 | Hot rolled plate, Ex. Ni and Cr being added from scrap of SUS316, Fe being further added from FeTi (**) |
| 30 | 0.54 | 0.03 | 1.0 | 0 | 0 | 1.0 | 0.72 | 950 | 23.1 | Hot rolled plate, Ex. entire Fe being added from SS400 (***) |
| 31 | 0.56 | 0.03 | 1.0 | 0.1 | 0.2 | 1.3 | 0.77 | 1010 | 18.7 | Hot rolled plate, Ex. most of Fe, Ni and Cr being added from sponge titanium formed near vessel |

Note:
*Q = [O] + 2.77[N] + 0.1{[Fe] + [Ni] + [Cr]}
** Mo in an amount of 2% in SUS316 becoming impurities in an amount of less than 0.02% in titanium alloy after melting.
*** C in an amount of 0.1% in SS400 becoming impurities in an amount of 0.01% in titanium alloy after melting In Table 4, Test Nos. 1, 2, 4 and 5 (hot rolled plates), Test Nos. 8, 9, 12 and 13 (bars) and Test Nos. 15 and 16 (cold rolled sheets) are examples based on the second viewpoint of the first aspect in the present invention. The features of each of the examples are described in the corresponding row in the remarks column.

Test No. 3 is a conventional example of a hot rolled plate which had a low Fe content and a low elongation not reaching the defined range. Test No. 6 is a comparative example of a hot rolled plate which had a low value of Q (oxygen equivalent value: [O]+2.77[N]+0.1[Fe]) and an insufficient tensile strength. It is evident from the comparison of Test No. 6 with Test No. 1 that since Q in Test No. 6 was slightly outside the lower limit of the defined range, the hot rolled plate did not attain a tensile strength of 850 MPa. Test No. 7 is a comparative example of a hot rolled sheet which had a high Q value due to a high oxygen content. Although the hot rolled plate had a high tensile strength, it had a considerably low elongation.

Test No. 10 is a comparative example of a bar which had a high nitrogen content and a low elongation and a low fatigue strength. Test No. 11 is a comparative example of a bar which had a low Fe content and a low elongation and a low fatigue strength. Moreover, Test No. 14 is a comparative example of a bar which had a solidification segregation and a low elongation and a low fatigue strength due to a high Fe content.

It can be seen from the above that a titanium alloy within the scope of the second viewpoint in the first aspect of the present invention has a tensile strength of at least 850 MPa and an elongation of at least 15%.

In Table 5, Test Nos. 17 to 19, 21, 22 and 24 are examples related to hot rolled sheets and cold rolled sheets based on the second viewpoint of the second aspect of the invention, and the features of each of the examples are described in the corresponding row in the remarks column.

Test No. 20 is a comparative example of a hot rolled plate which had a low total content of Fe+Ni+Cr, and which consequently did not attain an elongation in the defined range. Test No. 23 is a comparative example of a cold rolled plate which had a large content of Fe+Ni+Cr and a solidification segregation, and which had consequently a considerably lowered elongation. Test No. 25 is a comparative example of a cold rolled sheet which had an excessive content of Ni and an insufficient elongation. Test No. 26 is an example of a cold rolled sheet which had an excessive content of Cr and an insufficient elongation. It can be seen from the results described above that a titanium alloy within the scope of the second viewpoint in the second aspect of the invention has a tensile strength of at least 850 MPa and an elongation of at least 15%.

In Table 6, Test No. 27 is an example of a bar which was prepared with scrap of SUS430 as an Fe and Cr source and FeTi as an Fe source during VAR melting to have predetermined chemical components. Test No. 28 is an example of a hot rolled plate which was prepared with scrap SUS304 as an Fe, Ni and Cr source and FeTi as an Fe source to have predetermined chemical components. Test No. 29 is an example of a hot rolled plate which was prepared with scrap of SUS316 as an Fe, Ni and Cr source and FeTi as an Fe source to have predetermined chemical components.

Test No. 30 is an example of a bar which was prepared with scrap of SUS400 as an Fe source to have predetermined chemical components.

Furthermore, Test No. 31 is an example of a hot rolled plate which was prepared with cutout sponge titanium containing Fe, Ni and Cr which had invaded from a stainless steel vessel in the step of producing sponge titanium, to have predetermined chemical components.

The contents of the chemical components of the samples are as shown in Table 6. Moreover, each of the samples had a tensile strength of at least 850 MPa and an elongation of at least 15%, namely in the range of the second viewpoint of the first and the second aspect in the invention, and exhibited excellent properties.

EXAMPLE 3

A high strength, high ductility titanium alloy having a tensile strength of at least 850 MPa and an elongation of at least 15% was produced on the basis of the second viewpoint of the present invention. In addition, "a comparative example" in the present invention signifies that it is outside the scope of the second viewpoint and does not necessarily signify that it is outside the scope of the first viewpoint.

Figure 2:
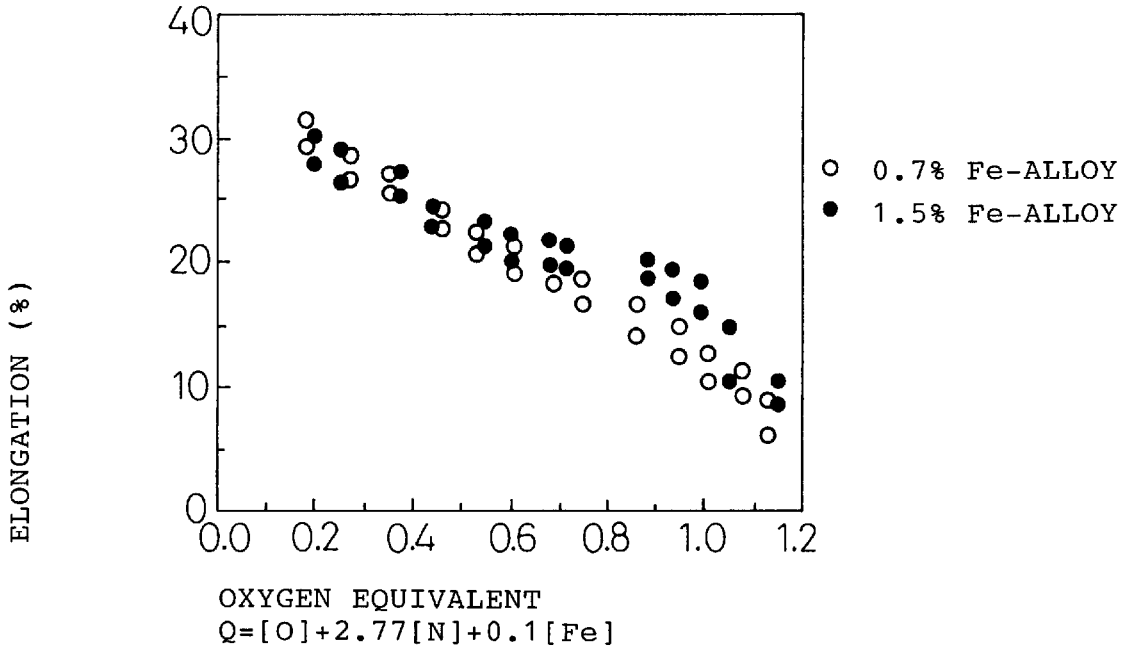
FIG. 2 is a graph showing the relationship between a Q value and an elongation.

Samples containing 1.5% by weight of Fe (examples) or 0.7% by weight of Fe (comparative examples) and having Q values as shown in Table 7 were prepared as described below. Cylindrical ingots having a diameter of 100 mm were melted by plasma arc melting. The ingots were heated to 1,000° C., and forged to slabs having a thickness of 80 mm. The slabs were then heated to 850° C., and hot rolled to hot rolled plates having a thickness of 4 mm. The hot rolled plates were annealed at 700° C. for 1 hr. The samples thus obtained were subjected to the tensile test described in Example 1. The results thus obtained are plotted and shown in FIGS. 1 and 2.

It is understood from the figures that the alloys containing 1.5% of Fe in the present invention (denoted by the mark o) exhibit improved tensile strength and elongation from a Q value of at least 0.5, in comparison with conventional alloys (0.7% Fe, denoted by the mark •). The improvement becomes particularly significant when Q=0.68–1.00.

TABLE 7

| Chemical component (wt. %) | | | | Tensile strength (MPa)** | | Elongation (%)** | | |
|---|---|---|---|---|---|---|---|---|
| Fe | O | N | Q* | min. | max. | min. | max. | Remarks |
| 0.7 | 0.08 | 0.01 | 0.18 | 590 | 610 | 29.3 | 31.4 | Comp. Ex |
| 0.7 | 0.17 | 0.01 | 0.27 | 650 | 670 | 26.5 | 28.5 | Comp. Ex |
| 0.7 | 0.25 | 0.01 | 0.35 | 700 | 730 | 25.5 | 27.0 | Comp. Ex |
| 0.7 | 0.33 | 0.02 | 0.46 | 770 | 790 | 22.7 | 24.1 | Comp. Ex |
| 0.7 | 0.40 | 0.02 | 0.53 | 790 | 820 | 20.6 | 22.5 | Comp. Ex |
| 0.7 | 0.48 | 0.02 | 0.61 | 840 | 860 | 19.2 | 21.4 | Comp. Ex |
| 0.7 | 0.56 | 0.02 | 0.69 | 890 | 910 | 18.3 | 19.5 | Comp. Ex |
| 0.7 | 0.60 | 0.03 | 0.75 | 920 | 950 | 16.7 | 18.6 | Comp. Ex |
| 0.7 | 0.71 | 0.03 | 0.86 | 1000 | 1030 | 14.0 | 16.6 | Comp. Ex |
| 0.7 | 0.77 | 0.04 | 0.95 | 1050 | 1080 | 12.5 | 15.0 | Comp. Ex |
| 0.7 | 0.83 | 0.04 | 1.01 | 1070 | 1110 | 10.5 | 12.8 | Comp. Ex |
| 0.7 | 0.90 | 0.04 | 1.08 | 1120 | 1170 | 9.2 | 11.5 | Comp. Ex |
| 0.7 | 0.95 | 0.04 | 1.13 | 1150 | 1190 | 6.1 | 9.1 | Comp. Ex |
| 1.5 | 0.04 | 0.005 | 0.20 | 600 | 620 | 28.0 | 30.1 | Comp. Ex |
| 1.5 | 0.07 | 0.01 | 0.25 | 640 | 660 | 26.3 | 29.0 | Comp. Ex |
| 1.5 | 0.19 | 0.01 | 0.37 | 720 | 740 | 25.2 | 27.3 | Comp. Ex |
| 1.5 | 0.23 | 0.02 | 0.44 | 790 | 810 | 22.8 | 24.4 | Comp. Ex |
| 1.5 | 0.34 | 0.02 | 0.55 | 860 | 890 | 21.3 | 23.2 | Ex. |
| 1.5 | 0.39 | 0.02 | 0.60 | 890 | 920 | 20.0 | 22.3 | Ex. |
| 1.5 | 0.45 | 0.03 | 0.68 | 940 | 960 | 19.7 | 21.8 | Ex. |
| 1.5 | 0.49 | 0.03 | 0.72 | 1000 | 1030 | 19.5 | 21.3 | Ex. |
| 1.5 | 0.62 | 0.04 | 0.88 | 1110 | 1140 | 18.6 | 20.2 | Ex. |
| 1.5 | 0.67 | 0.04 | 0.93 | 1180 | 1210 | 17.1 | 19.3 | Ex. |
| 1.5 | 0.73 | 0.04 | 0.99 | 1200 | 1250 | 16.0 | 18.5 | Ex. |
| 1.5 | 0.79 | 0.04 | 1.05 | 1250 | 1280 | 10.5 | 15.0 | Comp. Ex |
| 1.5 | 0.89 | 0.04 | 1.15 | 1270 | 1330 | 8.5 | 10.5 | Comp. Ex |

Note:
*Q = [O] + 2.77[N] + 0.1
**the maximum value and the minimum value obtained from 5 samples

INDUSTRIAL APPLICABILITY

As explained above, the present invention provides a high strength, high ductility titanium alloy which was prepared by increasing an Fe content as a strengthening element while the N content is decreased, adjusting the contents of strengthening elements O, N and Fe, or those of strengthening elements O, N, Fe, and Cr and Ni (Cr and Ni replacing part of Fe) through adjusting an oxygen equivalent value Q. Moreover, according to the present invention, the strengthening elements mentioned above can be supplied from low cost raw materials, and, therefore, the titanium alloy may be produced at low cost. Accordingly, the present invention is extremely advantageous from an industrial standpoint.

We claim:

1. A high strength, high ductility titanium allow free of Al, V and Mo and comprising O, N and Fe as strengthening elements and the balance substantially Ti, the contents of the strengthening elements satisfying the following relationships (1) to (3):

(1) from 0.9 to 2.3% by weight of Fe, (2) up to 0.05% by weight of N, and (3) an oxygen equivalent value Q, which is defined by the formula mentioned below, of 0.40 to 1.00

$$Q=[O]+2.77[N]+0.1[Fe]$$

wherein [O] is the oxygen content (% by weight), [N] is the nitrogen content (% by weight) and [Fe] is the iron content (% by weight), the titanium alloy having a tensile strength of at least 700 MPa and an elongation of at least 15%.

2. A high strength, high ductility titanium alloy free of Al, V and Mo and comprising O, N, Fe and at least one element selected from Cr and Ni as strengthening elements and the balance substantially Ti, the contents of the strengthening elements satisfying the following relationships (1) to (6):

(1) from 0.9 to 2.3% by weight of the total amount of Fe, Cr and Ni, (2) at least 0.4% by weight of Fe, (3) up to 0.25% by weight of Cr, (4) up to 0.25% by weight of Ni, (5) up to 0.05% by weight of N, and (6) an oxygen equivalent value Q, which is defined by the formula mentioned below, of 0.40 to 1.00

$$Q=[O]+2.77[N]+0.1\{[Fe]+[Cr]+[Ni]\}$$

wherein [O] is the oxygen content (% by weight), [N] is the nitrogen content (% by weight), [Fe] is the iron content (% by weight), [Cr] is the Cr content (% by weight) and [Ni] is the Ni content (% by weight), the titanium alloy having a tensile strength of at least 700 MPa and an elongation of at least 15%.

3. The high strength, high ductility titanium alloy as claimed in claim 1, wherein the oxygen equivalent value Q is from 0.40 to 0.68, and the titanium alloy has a tensile strength of 700 to 900 MPa and an elongation of at least 20%.

4. The high strength, high ductility titanium alloy as claimed in claim 1, wherein the oxygen equivalent value Q is from 0.50 to 1.00, and the titanium alloy has a tensile strength of at least 850 MPa and an elongation of at least 15%.

5. The high strength, high ductility titanium alloy as claimed in claim 4, wherein the oxygen equivalent value Q is from greater than 0.68 to 1.00, and the titanium alloy has a tensile strength exceeding 900 MPa.

6. The high strength, high ductility titanium alloy as claimed in claim 2, wherein the oxygen equivalent value Q is from 0.40 to 0.68, and the titanium alloy has a tensile strength of 700 to 900 MPa and an elongation of at least 20%.

7. The high strength, high ductility titanium alloy as claimed in claim 2, wherein the oxygen equivalent value Q is from 0.50 to 1.00, and the titanium alloy has a tensile strength of at least 850 MPa and an elongation of at least 15%.

8. The high strength, high ductility titanium alloy as claimed in claim 7, wherein the oxygen equivalent value Q is from greater than 0.68 to 1.00, and the titanium alloy has a tensile strength exceeding 900 MPa.

9. A process for producing a high strength, high ductility titanium alloy comprising O, N and Fe as strengthening elements and the balance substantially Ti, the contents of the strengthening elements satisfying the following relationships (1) to (3):

(1) from 0.9 to 2.3% by weight of Fe, (2) up to 0.05% by weight of N, and (3) an oxygen equivalent value Q, which is defined by the formula mentioned below, of 0.40 to 1.00

$$Q=[O]+2.77[N]+0.1[Fe]$$

wherein [O] is the oxygen content (% by weight), [N] is the nitrogen content (% by weight) and [Fe] is the iron content (% by weight), the titanium alloy having a tensile strength ot at least 700 MPa and an elongation of at least 15%, the process comprising charging at least one steel selected from carbon steels and stainless steels to a melt ot titanium during the production of said titanium alloy, so that at least part of Fe as the strengthening element is introduced from said steel to said titanium alloy.

10. A process for producing a high strength, high ductility titanium alloy comprising O, N, Fe and at least one element selected from Cr and Ni as strengthening elements and the balance substantially Ti, the contents of the strengthening elements satisfying the following relationships (1) to (6):

(1) from 0.9 to 2.3% by weight of the total amount of Fe, Cr and Ni, (2) at least 0.4% by weight of Fe, (3) up to 0.25% by weight of Cr, (4) up to 0.25% by weight of Ni, (5) up to 0.05% by weight of N, and (6) an oxygen equivalent value Q, which is defined by the formula mentioned below, of 0.40 to 1.00

$$Q=[O]+2.77[N]+0.1\{[Fe]+[Cr]+[Ni]\}$$

wherein [O] is the oxygen content (% by weight), [N] is the nitrogen content (% by weight), [Fe] is the iron content (% by weight), [Cr] is the Cr content (% by weight) and [Ni] is the Ni content (% by weight), the titanium alloy having a tensile strength of at least 700 MPa and an elongation of at least 15%, the process comprising charging at least one steel selected from carbon steels and stainless steels to a melt of titanium during the production of said titanium alloy, so that at least part of Fe, Cr and Ni as the strengthening elements is introduced from said steel to said titanium alloy.

11. A process for producing a high strength, high ductility titanium alloy comprising O, N and Fe as strengthening elements and the balance substantially Ti, the contents of the strengthening elements satisfying the following relationships (1) to (3):

(1) from 0.9 to 2.3% by weight of Fe, (2) up to 0.05% by weight of N, and (3) an oxygen equivalent value Q, which is defined by the formula mentioned below, of 0.40 to 1.00

$$Q=[O]+2.77[N]+0.1[Fe]$$

wherein [O] is the oxygen content (% by weight), [N] is the nitrogen content (% by weight) and [Fe] is the iron content (% by weight), the titanium alloy having a tensile strength of at least 700 MPa and an elongation of at least 15%, the process comprising:

producing sponge titanium in a vessel made from a steel containing Fe, whereby Fe from walls or bottom or both of said vessel is transferred into said sponge titanium, and then charging said sponge titanium containing said Fe as at least part of the source for Fe as a strengthening element in the production of the titanium alloy.

12. A process for producing a high strength, high ductility titanium alloy comprising O, N, Fe and at least one element selected from Cr and Ni as strengthening elements and the balance substantially Ti, the contents of the strengthening elements satisfying the following relationships (1) to (6):

(1) from 0.9 to 2.3% by weight of the total amount of Fe, Cr and Ni, (2) at least 0.4% by weight of Fe, (3) up to 0.25% by weight of Cr, (4) up to 0.25% by weight of Ni, (5) up to 0.05% by weight of N, and (6) an oxygen equivalent value Q, which is defined by the formula mentioned below, of 0.40 to 1.00

$$Q=[O]+2.77[N]+0.1\{[Fe]+[Cr]+[Ni]\}$$

wherein [O] is the oxygen content (% by weight), [N] is the nitrogen content (% by weight), [Fe] is the iron content (% by weight), [Cr] is the Cr content (% by weight) and [Ni] is the Ni content (% by weight), the titanium alloy having a tensile strength of at least 700 MPa and an elongation of at least 15%, the process comprising:

producing sponge titanium in a vessel made from a steel containing at least one element selected from Fe, Cr and Ni whereby said at least one element from walls or bottom or both of said vessel is transferred into said sponge titanium, and then charging said sponge titanium containing said at least one element as at least part of the source for the at least one element selected from Fe, Cr and Ni as the strengthening element in the production of the titanium alloy.

* * * * *